United States Patent [19]

Goodman

[11] Patent Number: 5,027,472

[45] Date of Patent: Jul. 2, 1991

[54] REPOSITIONABLE TOILET SEAT HANDLE ASSEMBLY

[76] Inventor: Donald W. Goodman, Box 460, Port Isabel, Tex. 78578

[21] Appl. No.: 525,847

[22] Filed: May 21, 1990

[51] Int. Cl.[5] ..... A47K 13/10

[52] U.S. Cl. ..... 16/114 R; 4/251; 24/569

[58] Field of Search ..... 16/114 R, 110 R, 124; 24/486, 525, 569; 248/231.4, 316.4, 689; 4/251

[56] References Cited

U.S. PATENT DOCUMENTS

| | | | |
|---|---|---|---|
| 624,211 | 5/1899 | Hill | 24/569 |
| 1,929,539 | 10/1933 | Stevernagel | 24/569 |
| 1,999,555 | 4/1935 | Adams | 4/251 |
| 3,191,193 | 6/1965 | Bogenberger | 4/251 |
| 3,316,604 | 5/1967 | Leger | 24/525 |
| 3,606,391 | 9/1971 | Sinnott | 24/525 |
| 3,717,884 | 2/1973 | Mantooth | 4/237 |
| 3,783,455 | 1/1974 | Vanderbrook | 4/1 |
| 4,129,907 | 12/1978 | Vaughn et al. | 4/251 |
| 4,269,178 | 5/1981 | Keene | 24/569 |
| 4,805,246 | 2/1989 | De Vargas et al. | 4/251 |
| 4,843,656 | 7/1989 | Forman | 4/251 |
| 4,875,251 | 10/1989 | Hazard | 16/111 R |

*Primary Examiner*—Richard K. Seidel
*Assistant Examiner*—J. Miner
*Attorney, Agent, or Firm*—David L. Mossman

[57] ABSTRACT

A toilet seat handle assembly which may be readily and easily repositioned on toilet seats of a large range of widths without tools is described. The assembly has two facing clamps spanned by a bolt. The bolt threads into one of the clamps, but passes through the other clamp in such a manner that it slides upon the middle of the bolt. A handle threads onto the opposite end of the bolt, such that the second clamp slides over the bolt between the first clamp and the handle. With the clamps in position on the underside of a conventional toilet seat, bridging the inner and outer margins of one side of the seat ring, the handle may be conventionally rotated to tighten the clamps to affix the assembly. Thus, the handle serves the dual purpose of the installing and removal mechanism, as well as the handle for raising and lowering the toilet seat without the need for touching the seat itself.

13 Claims, 1 Drawing Sheet

REPOSITIONABLE TOILET SEAT HANDLE ASSEMBLY

FIELD OF THE INVENTION

The invention relates to seats for toilets, water closets and the like, and in particular relates to handles for toilet seats, and the like.

BACKGROUND OF THE INVENTION

It is understood that a commonly encountered problem in the use of the conventional toilet or water closet is that the user must touch the seat in order to raise and lower it onto the toilet bowl. Toilet seats, and particularly the undersides thereof, due to their proximity to the bowl, tend to be unsanitary, and few people, if any, disinfect them after use. This concern is particularly acute as regards public toilets.

A number of structures have been devised to assist in the raising and the lowering of a conventional toilet seat. However, most of these prior structures cannot be readily affixed to the toilet seat without tools, making them generally unmanageable or difficult for those not adept with tools. The positions of these handles also cannot be readily changed after they are installed.

For example, U.S. Pat. No. 1,999,555 describes a sanitary seat lift with a drip ridge, adapted to be screwed to the underside of a conventional water closet bowl seat. A toilet seat attachment held in place by a biasing spring web is disclosed in U.S. Pat. No. 3,191,193. While the springs certainly would hold the attachment in place for a time, it is anticipated that the spring wires would eventually fatigue and fail.

U.S. Pat. No. 3,717,884 mentions a lifting handle for a toilet seat, consisting of a plate-like flange which can be fastened to the underside of a toilet seat by screws, with a laterally projecting hand grip having top and bottom ribs in the form of closed loops. The bottom rib depends adjacent the toilet seat so as to act as a splash deflector. It is noted, however, that the lifter must be permanently affixed by means of screws.

A toilet operating assembly for protecting the hands of the use of a toilet against germs is described in U.S. Pat. No. 3,783,455. The device involves an operating assembly being adapted to attach to a toilet seat permanently by means of screws or the like, and includes a partially housed, vapor emitting wick, separating an operating handle and the toilet seat. U.S. Pat. No. 4,129,907 details a toilet seat operating assembly for protecting the hands of a user of the toilet seat against bacteria. The operating assembly is adapted to be permanently attached to a toilet seat, by means of screws, and includes a spherical hand-engaging portion which can be readily removed for cleaning and sanitizing.

A handle attachable to the underside of a toilet seat is disclosed in U.S. Pat. No. 4,805,246 for the purpose of manually lifting or lowering the seat in a sanitary manner. The handle includes an elongated member having an attachment portion securable to the edge marginal region of the seat and a handle portion cantilevered outwardly in position for grasping by the fingers of the user. A deodorant cake is mountable from the attachment portion and the handle portion, including a display area for carrying alpha/numeric or graphic representations in either flat, relief or raised orientation. A cover or sleeve may be inserted over the handle portion which is of sanitary composition or a band of sanitary material may be wrapped around the handle portion. Attachment is taught by means of adhesive tape. Even so, the attachment is considered permanent.

Also of interest is a toilet seat handle device for attachment to a toilet seat as an aid to raising and lowering the toilet seat without having to touch the seat, as described in U.S. Pat. No. 4,875,251. The handle is attached at one of its ends to the toilet seat and projects outwardly beyond the periphery thereof. Attachment may be made permanently by means of adhesive or screws.

By way of further, though less important information, U.S. Pat. No. 4,843,656 teaches a one-piece toilet seat comprising a rim having a central opening. The toilet seat rim has a front and back section. There is an imaginary axis passing through the front and back sections of the toilet seat rim. This axis lies generally perpendicular to the plane of the person using the toilet seat. The toilet seat rim possesses a lifting tab which extends from the rim outwardly of the rim, preferably at an acute angle to the axis. In this way, the toilet seat rim may be raised and lowered by grasping the tab.

It should be noted that all of the previous devices discussed above are permanently affixed and cannot be moved after attachment. Many of the handles require tools or special expertise for installation. Customers not handy with a screwdriver and/or a drill may have difficulty with these sorts of handles. Even those which do not require screws, such as those of U.S. Pat. Nos. 4,805,246 and 4,875,251, but which use adhesive for fastening cannot readily be removed after initial placement. Position adjustment is important for the installation of a toilet seat handle, since it is quite likely that after placement it is discovered that the position is inconvenient, for example, if the handle interferes with the natural position of the user's leg while the user is seated. Since during placement the installer is in a very different position than when using the toilet, he or she may very likely misjudge the proper position. Thus, a mechanism for quickly and easily adjusting the position of the handle would be greatly desired.

Only U.S. Pat. No. 3,191,193 seems to teach a toilet seat handle which can be quickly and easily placed. However, it is to be noted that device therein cannot be adapted to a wide variety of toilet seat widths, but is limited to a fairly narrow range of widths. While many commercially available toilet seats may come in a standard dimension, there is an increasing variety available on the market. Thus, it would be a useful advance in the art to provide a quickly repositionable toilet seat handle that would accommodate a large range of widths.

SUMMARY OF THE INVENTION

Accordingly, it is an object of the present invention to provide a toilet seat handle assembly that may be easily and quickly repositioned.

It is another object of the present invention to provide a novel toilet seat handle assembly that may accommodate and adapt to a large range of toilet seat widths.

It is yet another object of the invention to provide a toilet seat handle assembly that may be readily installed and removed without tools, and with a minimum of moving parts.

In carrying out these and other objects of the invention, there is provided, in one form, a quick-attaching toilet seat handle assembly for fastening to the underside of a toilet seat, having a first clamp with a first clamp body; a first toilet seat grasping mechanism extending from the first clamp body; and a threaded hole in the first clamp body, the threaded hole having a diameter. Also present is a second clamp having a second clamp body; a second toilet seat grasping mechanism extending from the second clamp body; and a sliding hole through the second clamp body, the sliding hole having a diameter larger than the diameter of the first threaded hole in the first clamp body. Connecting the two clamps is a threaded bolt having a first end and second end, where the first end is mated with the first threaded hole in the first clamp body, and where the bolt extends through the sliding hole in the second clamp body. Finally, there is a handle having a second threaded hole mated with the second end of the threaded bolt.

DETAILED DESCRIPTION OF THE INVENTION

Figure 1:
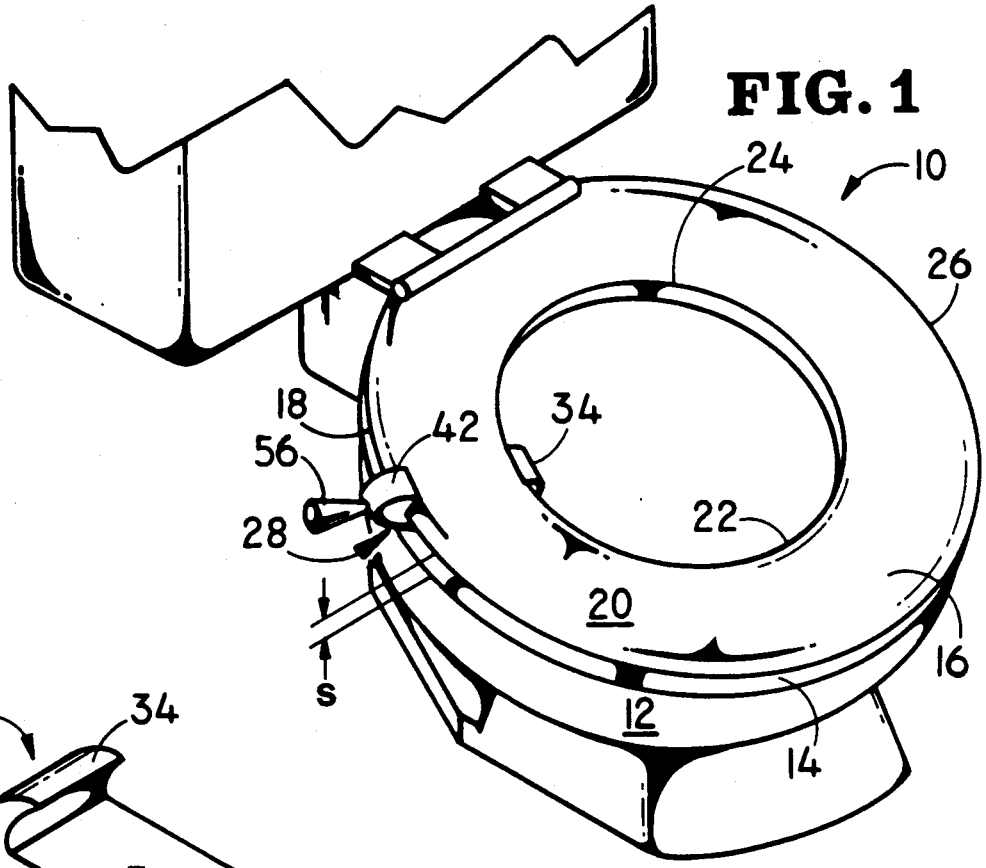
FIG. 1 is perspective view of a conventional toilet with the novel toilet seat handle assembly of the present invention installed on the side of the seat thereof.
Figure 2:
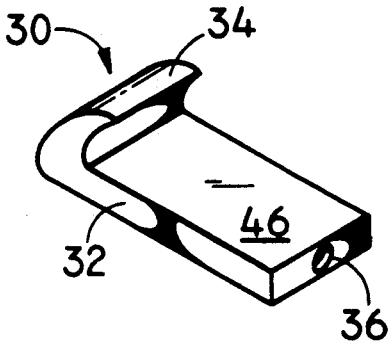
FIG. 2 is a perspective partial detail view showing the first clamp body of the novel toilet seat handle assembly.
Figure 3:
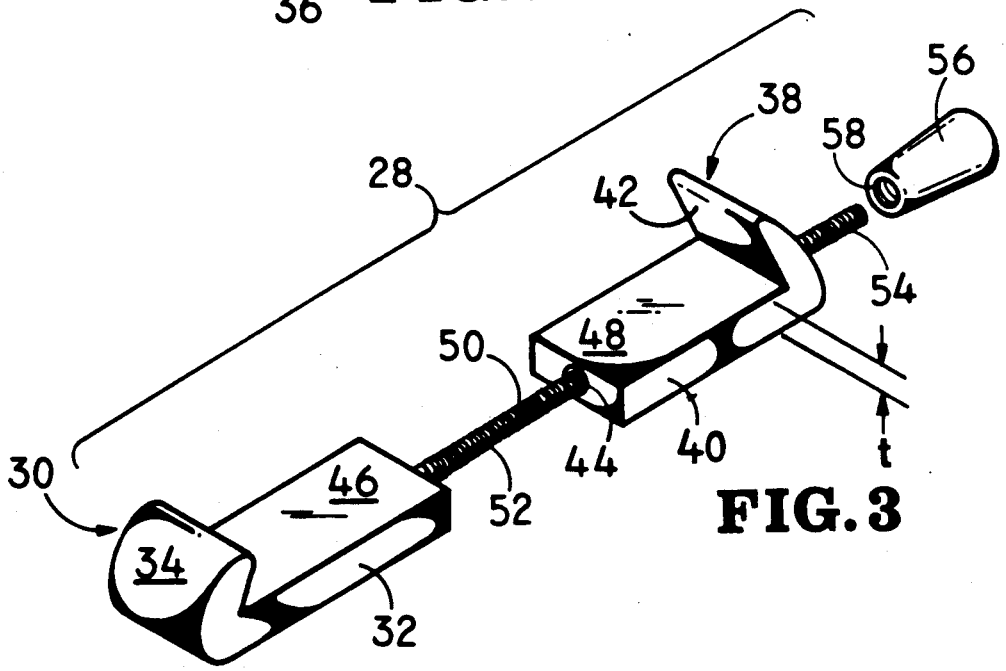
FIG. 3 is an exploded, perspective view of the toilet seat handle assembly of this invention showing all of the major parts thereof.

It has been discovered that a toilet seat handle assembly may be made which is quickly and easily installed and removed from toilet seats having a large variety of widths between its inner and outer margins without the use of any tools. Shown in FIG. 1 is a conventional toilet 10 having a bowl 12 with an upper surface 14 upon which a conventionally shaped toilet seat 16 rests. As is typical, the bottom surface or underside 18 of the toilet seat 16 is spaced apart from the upper surface 14 of the bowl 12 by a plurality of resilient spacers or feet (not shown) providing a gap or space "s" between the seat 16 and bowl 12. The toilet seat 16 has an upper surface 20 and an inner margin 22 defining an opening 24 and an outer margin 26 defining the overall perimeter of the seat 16. When the term toilet seat 16 "width" is used herein, it is meant the distance between the inner margin 22 and the outer margin 26.

Spanning the width of the toilet seat 16 is the novel repositionable toilet seat handle assembly 28 of the present invention. The toilet seat handle assembly 28 has a first clamp 30 with a first clamp body 32 and a first toilet seat grasping mechanism 34 extending from the first clamp body 32 and a first threaded hole 36 in the first clamp body 32. First threaded hole 36 has a diameter which will be further described momentarily.

Complementary to the first clamp 30 is a second clamp 38 with a second clamp body 40, a second toilet seat grasping mechanism 42 extending from the body 40 and a sliding hole 44 through the second clamp body 40 which has a diameter larger than the diameter of the first threaded hole 36 of the first clamp body 32. In the particular embodiment illustrated in the drawings, the first toilet seat grasping mechanism 34 and the second toilet seat grasping mechanism 42 are a pair of opposing, concave arcs that surround and grasp the inner margin 22 and outer margin 26 of the toilet seat 16, respectively. This configuration is simply one possible embodiment of the grasping mechanisms 34 and 42. For example, another possible embodiment is the use of separate blocks of hard rubber attached to the respective clamp bodies.

In another embodiment, the first clamp body 32 and second clamp body 40 have flat upper surfaces, 46 and 48, respectively. These flat surfaces permit the toilet seat handle assembly 28 to more closely engage the underside 18 of toilet seat 16. Note that in one embodiment, the respective first toilet seat grasping mechanism 34 and the second toilet seat grasping mechanism 42 are adjacent to and exterior of the upper, flat surfaces 46 and 48, respectively. Note also that the first and second clamp bodies 32 and 40 have a thickness "t". The thickness t of bodies 32 and 40 should be at least slightly less than the space s between the underside 18 of seat 16 and the upper surface 14 of bowl 12, so that the toilet seat handle assembly 28 may be accommodated within space s.

Continuing with the description of the toilet seat handle assembly 28, there is present a threaded bolt 50 having a first end 52 and a second end 54. First end 52 is threaded into the first threaded hole 36 in first clamp body 32. The bolt 50 extends completely through the sliding hole 44, being of relatively smaller diameter than hole 44, and terminates in second end 54 upon which a handle 56 with a second threaded hole 58 mates with the second end 54 of threaded bolt 50.

Bolt 50 need not be threaded along its entire length, as long as first end 52 and second end 54 are sufficiently threaded in length to perform their necessary functions, which will be described in more detail below. The second threaded hole 58 in handle 56 may run entirely through handle 56, or may only travel part-way through handle 56, not to appear on the opposite side. A preferred embodiment may be one in which bolt 50 does not protrude through handle 56, but where second end 54 is entirely covered by handle 56. In this way, the user is protected from harm from a protruding bolt end 54. Another way to address this concern is to design handle 56 to have rounded contours. It is a common experience to bump into items in a bathroom in the dark when attending to one's needs at night, and thus a rounded handle 56 could help avoid bruises or injury. Handle portion 56 could be at least partially made of a resilient material such as rubber or elastomer foam to further reduce the chances of injury. Other than these considerations, the handle 56 is not limited to any particular size or shape.

In operation, the repositionable toilet seat handle assembly 28 would be purchased completely assembled. Ideally, the handle 56 would be screwed out (counterclockwise, viewed from the handle 56) sufficiently to enable the first toilet seat mechanism 34 and second toilet seat grasping mechanism 42 to be easily placed on or near the inner margin 22 and outer margin 26 of a conventional toilet seat 16. The user would place the assembly 28 on the underside 18 of the seat 16 and tighten the clamps 30 and 38 together about the respective margins by simply turning handle 56 in a conventional tightening (clockwise) direction. Handle 56 presses against second clamp 38 forcing it tightly against outer margin 26 of seat 16 to tighten the clamps 30 and 38. If necessary, handle 56 could be turned counter-clockwise to open clamps 30 and 38 in the event that the toilet seat 16 was wider than usual.

If it became apparent though initial use that the handle assembly 28 was positioned inconveniently along the perimeter of toilet seat 16, the user would simply turn the handle counter-clockwise to loosen the clamps 30 and 38 and remove the assembly 28 and then reinstall it at a new position as described above. Although they may not be necessary for many users, flat upper surfaces 46 and 48 may aid some people in installing the handle assembly 28 flat against the underside 18 of the seat 16.

It will be appreciated that the repositionable toilet seat handle assembly 28 of the present invention has a number of advantages. Installation and removal may be accomplished quickly and easily without the use of any tools. The handle 56 serves the dual purpose of tightening and loosening the clamps 30 and 38, as well as the handle whereby the seat 16 is lowered and raised without having to touch seat 16 in an unsanitary fashion. Also important is the fact that the assembly 28 may be repositioned, if necessary, or easily removed, as in the case where the user moves to a different residence.

It will be further appreciated that many modifications may be made in the exact implementation of the repositionable toilet seat handle assembly invention illustrated in the drawings which would still fall within the spirit and scope of the invention as claimed herein. For example, it is anticipated that the grasping mechanisms 34 and 42 or the handle 56 have a different shape or size than those depicted. Additionally, the clamp bodies 32 and 40 may have a different shape than those shown, or may be designed to hide or protect the bolt 50 while permitting the bodies 32 and 40 to slide upon or within each other.

I claim:

1. A repositionable toilet seat handle assembly for fastening to an underside of a toilet seat, comprising:
- means for engaging the underside of a toilet seat, said means comprising
  - a first clamp having
    - a first clamp body;
    - a first toilet seat grasping means extending from the first clamp body; and
    - a first threaded hole in the first clamp body, the first threaded hole having a diameter;
  - a second clamp having
    - a second clamp body;
    - a second toilet seat grasping means extending from the second clamp body; and
    - a sliding hole through the second clamp body, the sliding hole having a diameter larger than the diameter of the first threaded hole in the first clamp body; and
  - a threaded bolt having a first end and second end, where the first end is mated with the first threaded hole in the first clamp body, and where the bolt extends through the sliding hole in the second clamp body; and
- a handle having a second threaded hole mated with the second end of the threaded bolt.

2. The repositionable toilet seat handle assembly of claim 1 where the second threaded hole in the handle does not entirely pierce the handle, and where the outer contour of the handle is rounded.

3. The repositionable toilet seat handle assembly of claim 1 where the first toilet seat grasping means and the second toilet seat grasping means comprise a pair of opposing, concave arcs.

4. The repositionable toilet seat handle assembly of claim 1 where the first clamp body and the second clamp body have upper surfaces for engaging the underside of the toilet seat, and where the upper surfaces are flat, and where the respective first toilet seat grasping means and the second toilet seat grasping means are adjacent to and exterior of the upper, flat surfaces.

5. The repositionable toilet seat handle assembly of claim 1 where the threaded bolt is not threaded along its entire length, but both first and second ends are threaded.

6. The repositionable toilet seat handle assembly of claim 1 where the handle is at least partially made of a resilient material.

7. A repositionable toilet seat handle assembly for fastening to an underside of a toilet seat, comprising:
- means for engaging the underside of a toilet seat, said means comprising
  - a first clamp having
    - a first clamp body;
    - a first toilet seat grasping means extending from the first clamp body; and
    - a first threaded hole in the first clamp body, the first threaded hole having a diameter;
  - a second clamp having
    - a second clamp body;
    - a second toilet seat grasping means extending from the second clamp body, where the first toilet seat grasping means and the second toilet seat grasping means comprise a pair of opposing, concave arcs; and
    - a sliding hole through the second clamp body, the sliding hole having a diameter larger than the diameter of the first threaded hole in the first clamp body; and
  - a threaded bolt having a first end and second end, where the first end is mated with the first threaded hole in the first clamp body, and where the bolt extends through the sliding hole in the second clamp body; and
- a handle having a second threaded hole mated with the second end of the threaded bolt, where the second threaded hole in the handle does not entirely pierce the handle.

8. The repositionable toilet seat handle assembly of claim 7 where the outer contour of the handle is rounded.

9. The repositionable toilet seat handle assembly of claim 7 where the first clamp body and the second clamp body have upper surfaces for engaging the underside of the toilet seat, and where the upper surfaces are flat, and where the respective first toilet seat grasping means and the second toilet seat grasping means are adjacent to and exterior of the upper, flat surfaces.

10. The repositionable toilet seat handle assembly of claim 7 where the threaded bolt is not threaded along its entire length, but both first and second ends are threaded.

11. The repositionable toilet seat handle assembly of claim 7 where the handle is at least partially made of a resilient material.

12. A repositionable toilet seat handle assembly for fastening to an underside of a toilet seat, comprising:
- means for engaging the underside of a toilet seat, said means comprising:
  - a first clamp having
    - a first clamp body;
    - a flat, upper surface on the first clamp body;
    - a first toilet seat grasping means extending from the first clamp body, adjacent to and exterior of the flat, upper surface; and
    - a first threaded hole in the first clamp body, the first threaded hole having a diameter;

a second clamp having a second clamp body;

a flat, upper surface on the second clamp body;

a second toilet seat grasping means extending from the second clamp body, adjacent to and exterior of the flat, upper surface, and where the first toilet seat grasping means and the second toilet seat grasping means comprise a pair of opposing, concave arcs; and a sliding hole through the second clamp body, the sliding hole having a diameter larger than the diameter of the first threaded hole in the first clamp body; and a threaded bolt having a first end and second end, where the first end is mated with the first threaded hole in the first clamp body, and where the bolt extends through the sliding hole in the second clamp body; and a handle having a second threaded hole mated with the second end of the threaded bolt, where the second threaded hole in the handle does not entirely pierce the handle, and where the outer contour of the handle is rounded and is at least partially made of a resilient material.

13. The repositionable toilet seat handle assembly of claim 11 where the threaded bolt is not threaded along its entire length, but both first and second ends are threaded.

* * * * *